US008496045B2

(12) United States Patent
Kikuchi

(10) Patent No.: US 8,496,045 B2
(45) Date of Patent: Jul. 30, 2013

(54) DIE-CAST CASTING APPARATUS AND DIE-CAST CASTING METHOD

(75) Inventor: Makoto Kikuchi, Nagoya (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/517,436

(22) PCT Filed: Dec. 17, 2010

(86) PCT No.: PCT/IB2010/003286
§ 371 (c)(1),
(2), (4) Date: Jun. 20, 2012

(87) PCT Pub. No.: WO2011/077215
PCT Pub. Date: Jun. 30, 2011

(65) Prior Publication Data

US 2012/0261086 A1 Oct. 18, 2012

(30) Foreign Application Priority Data

Dec. 21, 2009 (JP) ..... 2009-289319

(51) Int. Cl.
*B22D 17/00* (2006.01)
*B22D 17/30* (2006.01)

(52) U.S. Cl.
USPC ..... 164/113; 164/312

(58) Field of Classification Search
USPC ..... 164/113, 312, 136, 335, 336
See application file for complete search history.

(56) References Cited

U.S. PATENT DOCUMENTS

| | | | | |
|---|---|---|---|---|
| 3,690,517 | A | 9/1972 | Ott | |
| 7,971,628 | B2 * | 7/2011 | Lee et al. | 164/113 |
| 2004/0055735 | A1 * | 3/2004 | Hong et al. | 164/499 |
| 2007/0023159 | A1 * | 2/2007 | Taniguchi | 164/113 |
| 2007/0074842 | A1 * | 4/2007 | Manoff | 164/113 |
| 2007/0277953 | A1 * | 12/2007 | Ward et al. | 164/113 |

FOREIGN PATENT DOCUMENTS

| | | | |
|---|---|---|---|
| JP | 06-029761 U | | 4/1994 |
| JP | 2002-210551 A | * | 7/2002 |

OTHER PUBLICATIONS

International Search Report and Written Opinion for corresponding International Patent Application No. PCT/IB2010/003286 mailed May 16, 2011.
International Preliminary Report on Patentability for corresponding International Patent Application No. PCT/IB2010/003286 mailed Dec. 27, 2011.

* cited by examiner

*Primary Examiner* — Kevin P Kerns
(74) *Attorney, Agent, or Firm* — Sughrue Mion, PLLC

(57) ABSTRACT

A ladle (100) for a casting apparatus (1) includes a cylindrical melt pouring spout (120) through which a melt (M) is poured from an accommodation portion (110). Protrusions (121, 122) are formed on opposite sides along the inner circumference of the melt pouring spout (120) along the lower side and upper side in the vertical direction of the melt pouring spout (120). The cross sectional area of the protrusions (121, 122) in the axial section of the melt pouring spout (120) gradually increase, while the phase of the protrusions varies gradually in one circumferential direction of the melt pouring spout (120) from the upstream side towards the downstream side in the flow direction of the melt (M). In addition, the protrusions (121, 122) become gradually thinner and curve gradually in the respective phase variation direction towards the inside in the radial direction of the melt pouring spout (120).

3 Claims, 12 Drawing Sheets

DIE-CAST CASTING APPARATUS AND DIE-CAST CASTING METHOD

BACKGROUND OF THE INVENTION

1. Field of the Invention

The invention relates to a die-cast casting apparatus and a die-cast casting method.

2. Description of the Related Art

A die-cast casting method is generally available by which products are cast within a short period of time and in large amounts by supplying a melt under a pressure into a die. Appropriate die-cast casting apparatuses are used in the die-cast casting method. The die-cast casting apparatuses used in the die-cast casting method may be broadly classified into hot-chamber die-cast machines in which a pressurization chamber for injecting a melt is disposed in a melt holding furnace and cold-chamber die-cast machines in which a pressurization chamber for injecting a melt is not disposed in a melt holding furnace. Cold-chamber die-cast machines will be described below.

A die-cast casting machine includes a die in which a cavity is formed when a fixed mold and a movable mold are pressed together, a cylindrical sleeve that communicates with the cavity via a runner formed in the die, a ladle that supplies the melt into the sleeve (pressurization chamber), and a plunger that injects the melt supplied into the sleeve (pressurization chamber) into the cavity.

In die-cast casting, the following four steps are implemented in the stated order by using the above-described die-cast casting apparatus. First, the movable mold is pressed against the fixed mold and a cavity is formed in the die (mold clamping step); next, the melt is supplied into the sleeve with the ladle (melt pouring step); third, pressure is applied by the plunger to the space inside the sleeve, thereby injecting the melt supplied into the sleeve into the cavity (injection step), and finally, separating the movable mold from the fixed mold and removing the molded casting (mold opening step).

The ladle used in the melt pouring step is a container open at the top that includes a melt pouring spout provided so as to protrude outward. The ladle scoops up a predetermined amount of the melt from a holding furnace where the melt is stored. Then, the ladle is moved to a predetermined position and thereafter tilted at the melt pouring spout side. As a result, the melt is poured from the melt pouring spout towards the melt supply gate provided in the sleeve and the melt is supplied to the sleeve.

When the melt is thus poured into the melt supply gate of the sleeve by using the above-described ladle, the time period in which the entire melt is supplied from the ladle into the sleeve, that is, the pouring rate, is set by adjusting the speed at which the ladle is tilted (time required to tilt the ladle to a predetermined angle). When the pouring rate is low, that is, when a long time period is required to supply the melt from the ladle into the sleeve, the temperature of melt inside the sleeve decreases and the melt partially solidifies. Therefore, the resultant problem is not only that the casting time increases, but also that pressure propagation is reduced when the melt located in the sleeve is injected into the cavity by the plunger and casting pores (cavities) generated in the melt inside the sleeve cannot be completely eliminated. Accordingly, it is desirable to increase the pouring rate, that is, reduce the time period in which the melt is supplied from the ladle into the sleeve, but if the ladle tilting speed is too high, a large amount of melt is supplied into the pouring spout of the ladle. As a result, the melt can overflow from the pouring spout or be scattered and run over from the melt supply gate of the sleeve.

Accordingly, Japanese Patent Application Publication No. 2002-210551 (JP-A-2002-210551) describes a technique of configuring a melt pouring spout of a ladle as an almost cylindrical tube and providing a partition plate along the axial direction inside the pouring portion, thereby adjusting the flow of melt in the pouring portion of the ladle and preventing the melt from scattering and running over from the melt supply gate of the sleeve when the melt is poured.

However, with the technique described in JP-A-2002-210551, the melt and air cannot efficiently replace each other in the pouring portion of the ladle when the melt is poured and the pouring rate is insufficient.

SUMMARY OF INVENTION

The invention provides a die-cast casting apparatus and die-cast casting method that ensure rapid and accurate pouring.

A die-cast casting apparatus according to the first aspect of the invention includes: a die having a cavity formed inside thereof; a tubular sleeve, having an internal space that is communicated with the cavity, and in which a melt supply gate is formed, and communicates by the internal space with the outside via the melt supply gate; a ladle that includes an accommodation portion that holds a melt and a melt pouring spout that serves as a pouring gate, through which the melt accommodated in the accommodation portion is poured, wherein the ladle is tilted towards the melt pouring spout side such to pour the melt through the melt pouring spout towards the melt supply gate of the sleeve and thereby supply the melt into the sleeve, and a plunger provided slidably within the sleeve that is used to inject the supplied melt into the cavity, wherein the melt pouring spout of the ladle is cylindrical and protrudes outward from the accommodation portion continuously with the accommodation portion, and the melt pouring spout includes rotation means that rotates the melt in the circumferential direction in the melt pouring spout as the melt passes through the melt pouring spout when the melt is poured.

In the die-cast casting apparatus according to the first aspect, the rotation means may be a protrusion provided along the inner circumferential surface of the melt pouring spout that protrudes radially inward of the melt pouring spout, and the protrusion may be provided continuously along the axial direction in the melt pouring spout and may be formed such that a phase thereof varies gradually in one circumferential direction in the melt pouring spout from an upstream side towards a downstream side in a flow direction of the melt.

Further, in the die-cast casting apparatus according to the first aspect, the protrusion may be formed to become gradually thinner and curve gradually in one circumferential direction in the melt pouring spout towards the inside in the radial direction of the melt pouring spout.

Further, in the die-cast casting apparatus according to the first aspect, the protrusion may be formed to increase gradually in height from an upstream side towards a downstream side in a flow direction of the melt.

Further, in the die-cast casting apparatus according to the first aspect, the protrusion may be formed to increase gradually in width from an upstream side towards a downstream side in a flow direction of the melt.

Further, in the die-cast casting apparatus according to the first aspect, two protrusions may be provided along the inner circumferential surface of the melt pouring spout, and one of the two protrusions may be provided on the lower side in the vertical direction the melt pouring spout and may have a phase difference of 180 degrees with respect to the other of the two protrusions, which is provided on the upper side in the vertical direction.

Further, in the die-cast casting apparatus according to the first aspect, the rotation means may be a screw that is provided inside the melt pouring spout and rotates concentrically with the melt pouring spout, and the screw may rotate the melt in the circumferential direction of the melt pouring spout.

A die-cast casting method according to the second aspect of the invention uses the die-case casting apparatus according to the above-described first aspect in which the melt is supplied by pouring the melt into the sleeve from the ladle, wherein the melt poured out of the melt pouring spout of the ladle is caused to fall downstream, in the injection direction of the melt with the plunger, of the position of the melt supply gate in the axial direction of the sleeve.

Further, in the die-cast casting method according to the second aspect, a position of the ladle with respect to the sleeve when the melt may be poured out of the melt pouring spout of the ladle is set so that a rotational direction of the melt, as viewed from the upstream side in the flow direction of the melt, matches a rotational direction of the melt along the inner circumferential surface of the sleeve, as viewed from the upstream side in the injection direction of the melt with the plunger, when the melt is supplied into the sleeve.

In accordance with the invention, the melt poured out of the ladle can be spirally rotated along the pouring direction. Therefore, the replacement efficiency of the melt and air in the ladle during pouring is improved, pouring can be conducted at a high rate, and the melt poured out of the ladle can be imparted with straight advance ability and poured out accurately towards the melt supply gate of the sleeve.

BRIEF DESCRIPTION OF DRAWINGS

The foregoing and/or further objects, features and advantages of the invention will become more apparent from the following description of example embodiments with reference to the accompanying drawings, in which like numerals are used to represent like elements, and wherein.

DETAILED DESCRIPTION OF EMBODIMENTS

A casting apparatus 1, which is an embodiment of the die-cast casting apparatus according to the invention, will be described below with reference to FIGS. 1 to 5. The casting apparatus 1 is a cold-chamber die-cast machine in which a molded article is cast by pressing a melt M of a molten metal, such as an aluminum alloy into a predetermined casting mold and solidifying the melt.

Figure 1:
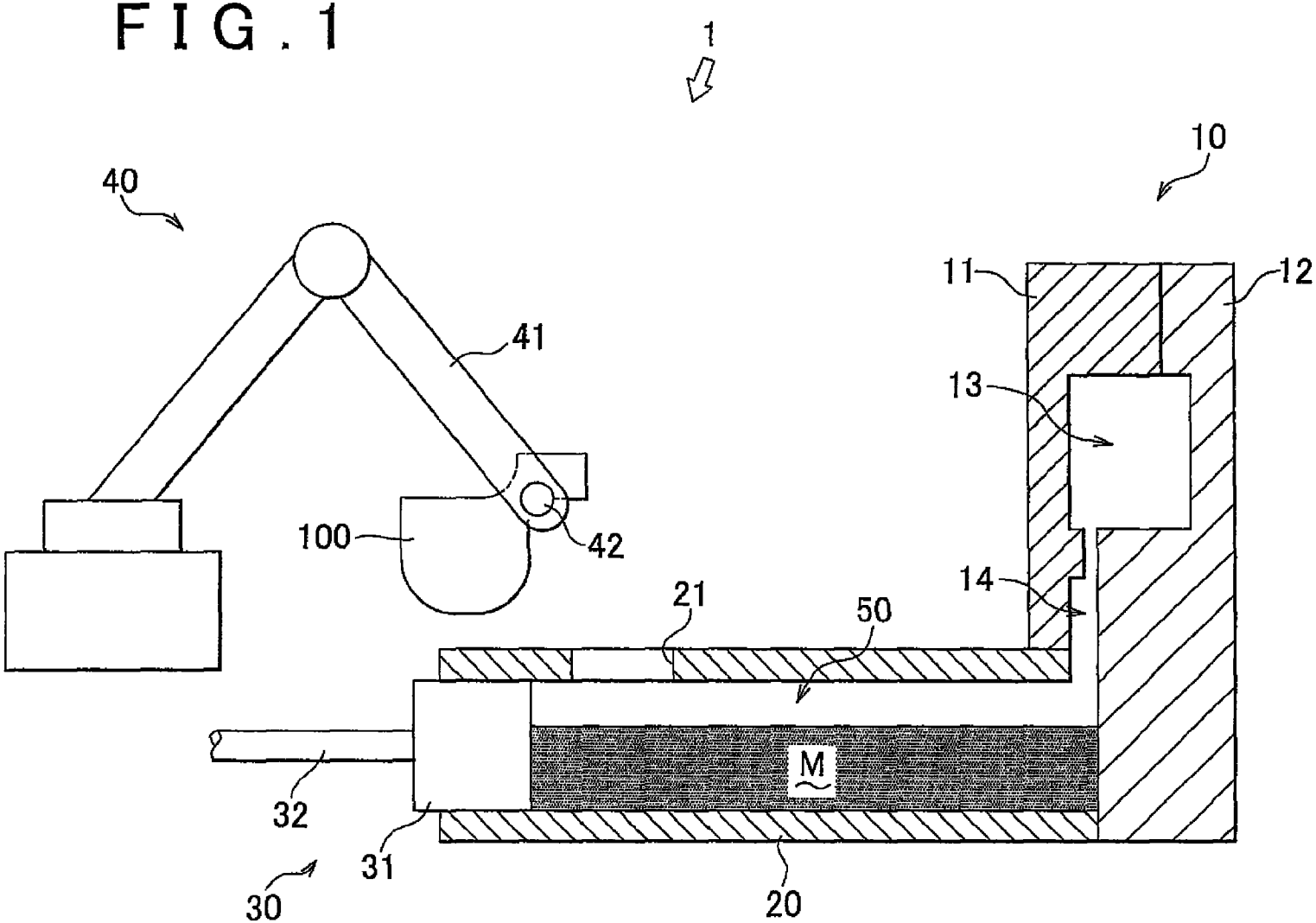
FIG. 1 illustrates the entire configuration of a die-cast casting apparatus according to one embodiment of the invention.

As shown in FIG. 1, the casting apparatus 1 includes a die 10, a sleeve 20, a plunger 30, and a pouring machine 40.

The die 10 is made from a metal and serves to cast a cast article. The die 10 is provided with a fixed mold 11 and a movable mold 12. A cavity 13 and a runner 14 are formed inside the die 10 by pressing the mating surfaces (mold separation surfaces) of the molds towards each other.

The fixed mold 11 is a member constituting part of the die 10 and fixed in a predetermined position. The movable mold 12 is a member constituting part of the die 10 and may be moved horizontally (in the horizontal direction shown in FIG. 1) towards and away from the fixed mold 11 through an appropriate control means. Recesses of predetermined shapes are formed in the mold separation surface of the fixed mold 11 (right side surface of the fixed mold 11 in FIG. 1) and the mold separation surface of the movable mold 12 (left side surface of the movable mold 12 in FIG. 1). When the movable mold 12 is moved by the control means and the mold separation surface of the fixed mold 11 is pressed against of the movable mold 12 in a predetermined position (mold clamping), the recess of the fixed mold 11 and the recess of the movable mold 12 form the cavity 13 and the runner 14.

The cavity 13 is a clearance formed inside the die 10 when the fixed mold 11 and the movable mold 12 are pressed against each other, and this clearance has a shape that corresponds to that of the cast article. The cast article is processed, for example by trimming, after casting, to obtain a final product.

The runner 14 is a clearance formed inside the die 10 when the fixed mold 11 and the movable mold 12 are pressed against each other. The runner 14 is a path that communicates with the cavity 13 and serves to supply the melt M into the cavity 13.

The sleeve 20 is a substantially cylindrical member that is open at both ends in the axial direction and temporarily holds the melt M inside thereof. A distal end of the sleeve 20 (the right end of the sleeve 20, as shown in FIG. 1) is connected to the die 10 so that the runner 14 and the internal space of the sleeve 20 communicate with each other. In other words, the inner space of the sleeve 20 communicates with the cavity 13 via the runner 14.

Further, the sleeve 20 is provided with a melt supply gate 21 through which the melt M is supplied into the sleeve 20. The melt supply gate 21 is a hole through which the inside of the sleeve 20 communicates with the outside of the sleeve 20. The melt supply gate is provided near the proximal end of the sleeve 20 (the left end of the sleeve 20, as shown in FIG. 1). Further, the melt supply gate 21 is open towards the upper surface of the sleeve 20, that is, upward in the vertical direction.

The plunger 30 is a unit that injects the melt M supplied into the sleeve 20 into the cavity 13 of the die 10. The plunger 30 is provided with a tip 31 and a rod 32.

The tip 31 is a member of an almost cylindrical shape formed to have an outer peripheral shape substantially matching the inner peripheral shape of the sleeve 20. The tip 31 is provided inside the sleeve 20 and may slide in the axial direction inside the sleeve 20.

The rod 32 is a rod-like member for causing the tip 31 to slide in the axial direction inside the sleeve 20. One end portion of the rod 32 is fixed to the tip 31 from the other end portion side of the sleeve 20 (left end portion of the sleeve 20 in FIG. 1), and the other end portion of the rod 32 is fixed to an actuator such as a hydraulic cylinder. The actuator slides the tip 31, via the rod 32, in the axial direction inside the sleeve 20.

Further, the open ends of the sleeve 20 are closed by the tip 31 and the movable mold 12, and a pressurization chamber 50 is formed within the sleeve 20. The space of the pressurization chamber 50 is formed between the tip 31 and the die 10 inside the sleeve 20, and the volume of the pressurization chamber changes with the movement of the tip 31.

Where the fixed mold 11 and the movable mold 12 are pressed together, the cavity 13 and the runner 14 are formed, and when the tip 31 is positioned closer to the left end portion of the sleeve 20, as shown in FIG. 1, than the melt supply gate 21, the melt M is poured by the pouring machine 40 into the sleeve 20, that is, into the pressurization chamber 50 through the melt supply gate 21. As the actuator slides the tip 31 into the die 10 inside the sleeve 20, the volume of the pressurization chamber 50 is reduced. Accordingly, the melt M supplied into the pressurization chamber 50 is injected towards the distal end of the sleeve 20 (right end side of the sleeve 20 in FIG. 1), and the melt M fills the cavity 13 via the runner 14. The melt M filling the cavity solidifies in the cavity 13, thereby molding a cast article.

The pouring machine 40 supplies the melt M into the pressurization chamber 50. The pouring machine 40 is provided with an arm 41 and a ladle 100.

The arm 41 sets the ladle 100 to a desired position and angle within a range between a holding furnace (not shown in the figure) in which the melt M is contained and the melt supply gate 21 of the sleeve 20. The arm 41 is connected via a rotary shaft 42 to the ladle 100. The rotary shaft 42 connects the arm 41 and the ladle 100. One end of the rotary shaft is rotatably connected to the arm 41, and the opposite end is fixed to the ladle 100. In other words, Thus the rotary shaft 42 rotates in the circumferential direction, the ladle 100 is rotated about the axial center of the rotary shaft 42, thereby changing the angle of the ladle 100.

Figure 2:
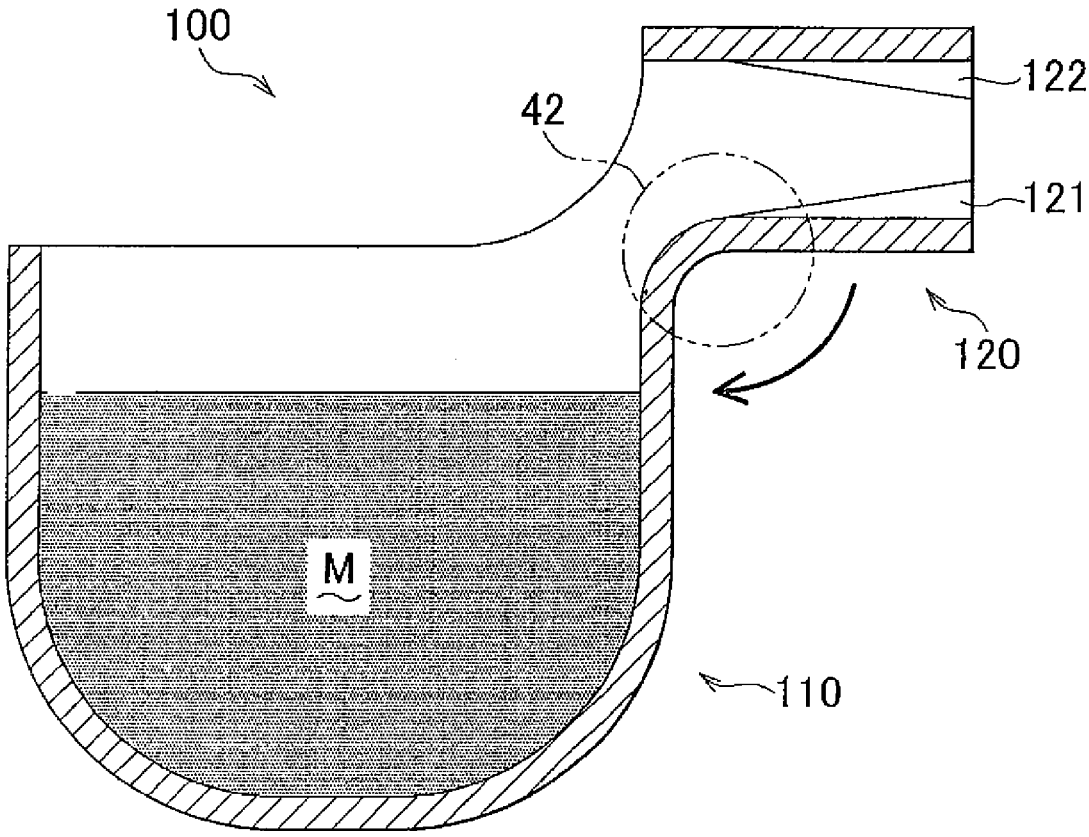
FIG. 2 is a side sectional view of a ladle according to one embodiment of the invention.

As shown in FIG. 2, the ladle 100 is a container provided with an accommodation portion 110 that is open upward (upper side in FIG. 2). The ladle scoops up a predetermined amount (amount necessary for casting the cast article) of the melt M contained in the holding furnace and temporarily holds the melt in the accommodation portion 110. Further, the ladle 100 also has a melt pouring spout 120 that serves as a pouring gate for the melt M held in the accommodation portion 110. Where the ladle is tilted toward the melt pouring spout 120 at a predetermined speed (rotated in the direction of an arrow in FIG. 2 about the rotary shaft 42), the melt M is poured through of the melt pouring spout 120 towards the melt supply gate 21 of the sleeve 20. The ladle 100 is preferably made from a material with excellent heat resistance, such as cast iron or ceramics, but may be made from any suitable kind of material.

Figure 3:
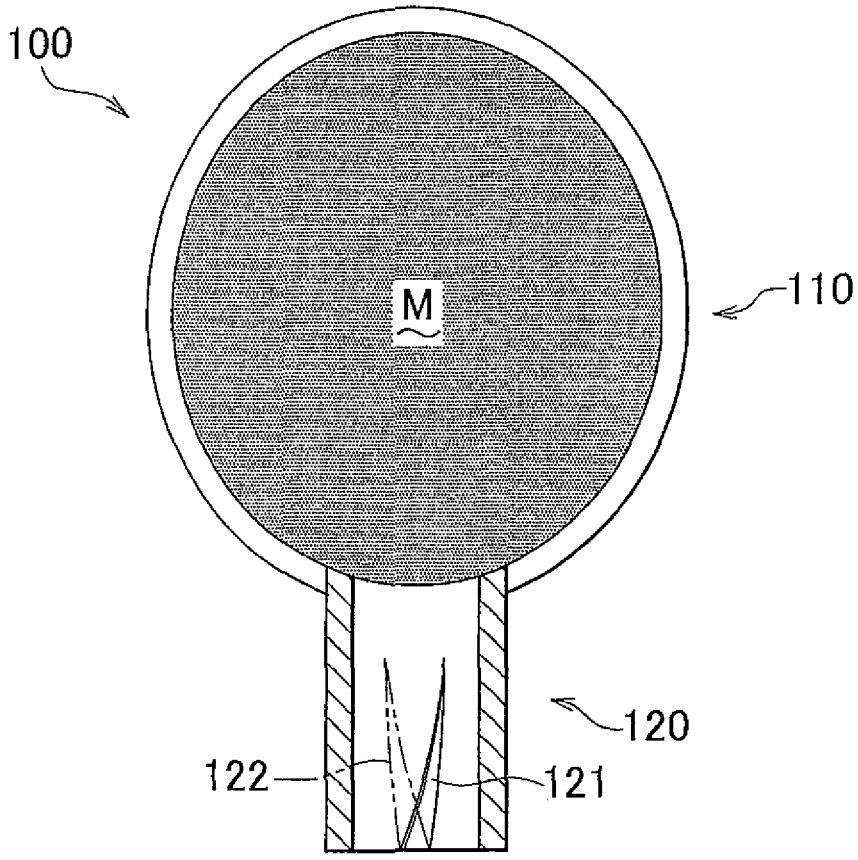
FIG. 3 is a plan sectional view of the ladle according to one embodiment of the invention.
Figure 4:
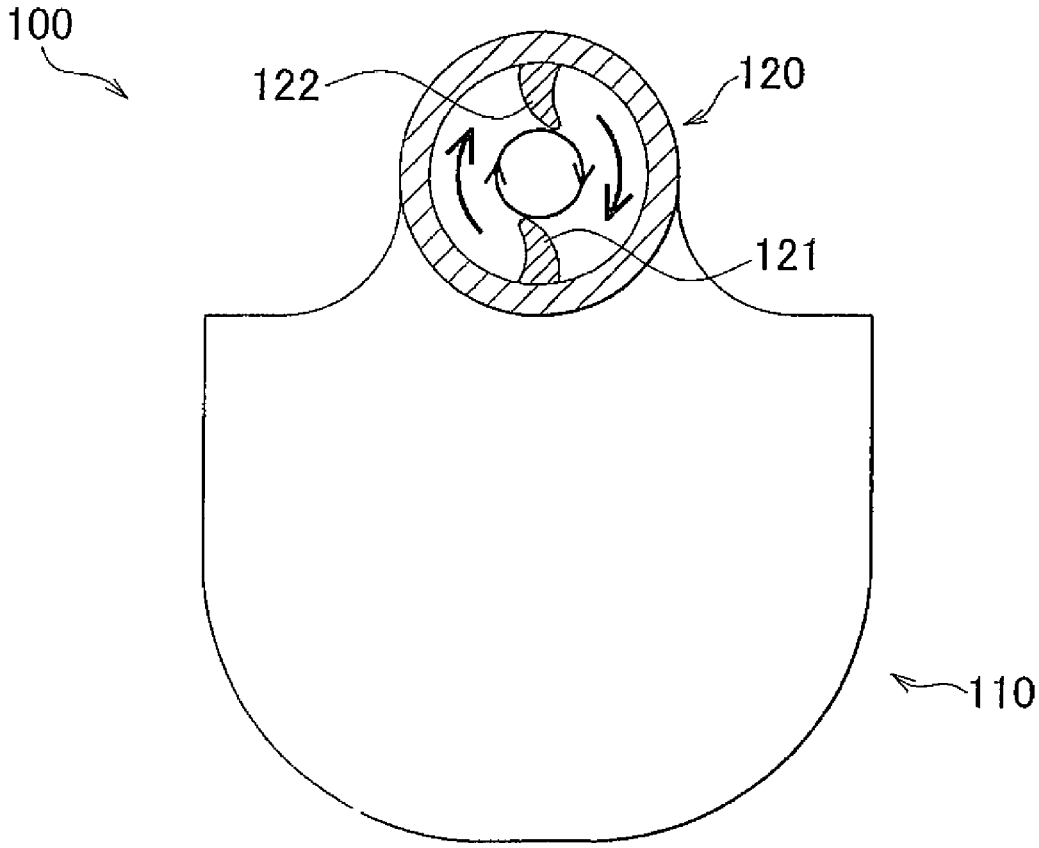
FIG. 4 is a front and partial end view of the ladle according to one embodiment of the invention.

As shown in FIGS. 2, 3, and 4, the melt pouring spout 120 is formed in a substantially cylindrical shape that protrude in the horizontal direction (horizontal direction in FIG. 2) away from the accommodation portion 110 and is disposed at the upper end (upper end in FIGS. 2 and 4) of the accommodation portion 110. The melt pouring spout 120 is configured such that when the ladle 100 is tilted to pour the melt, the melt M flows inside the melt pouring spout 120 in the axial direction and the melt pouring spout serves as a pouring gate for the melt M.

Two protrusions 121, 122 are provided along the inner circumferential surface of the melt pouring spout 120 and one of the two protrusions 121 is provided on the lower side in the vertical direction (lower side in FIGS. 2 and 4) of the melt pouring spout 120 and has a phase difference of 180 degrees with respect to the other of the two protrusions 122, which is provided on the upper side in the vertical direction (upper side in FIGS. 2 and 4). The protrusions 121, 122 are formed at the inner circumferential surface of the melt pouring spout 120 and are provided to rotate the melt M in the circumferential direction of the melt pouring spout 120 during pouring.

As shown in FIG. 2, the protrusions 121, 122 are provided continuously so that the height of the protrusions (length in the up-down direction in FIG. 2, that is, the size of protrusion from the inner circumferential surface of the melt pouring spout 120) increases gradually from the upstream side towards the downstream side (from the left side to the right side in FIG. 2) in the flow direction of the melt M as the melt is poured from the melt pouring spout 120.

Further, as shown in FIG. 3, the protrusions 121, 122 are formed so that the phases thereof varies gradually in one circumferential direction (clockwise direction or counterclockwise direction) in the melt pouring spout 120 from the upstream side towards the downstream side (from the upper side to the lower side in FIG. 3) in the flow direction of the melt M when poured. In the present embodiment, the phase of the protrusions 121, 122 varies in the clockwise direction (direction shown by arrows in FIG. 4), as viewed from the downstream side in the flow direction of the melt M during pouring. In other words, the phase of the protrusion 121 varies to the left in FIG. 3, and the phase of the protrusion 122 varies to the right in FIG. 3. The protrusions 121, 122 are also formed so that the widths thereof (the length in the horizontal direction in FIG. 3, that is, the length in the circumferential direction in the melt pouring spout 120) increases gradually from the upstream side towards the downstream side (from the upper side to the lower side in FIG. 3).

Further, as shown in FIG. 4, the protrusions 121, 122 are formed so that they gradually decrease in size (the length in the horizontal direction in FIG. 4, that is, the length in the circumferential direction in the melt pouring spout 120 is small) and gradually curve in one circumferential direction (clockwise direction or counterclockwise direction) in the melt pouring spout 120, that is, in the respective phase variation direction of the protrusions 121, 122 towards the inside in the radial direction of the melt pouring spout 120. In the present embodiment, the protrusions 121, 122 curve in the clockwise direction (directions shown by arrows in FIG. 4), as viewed from the downstream side in the flow direction of the melt M during pouring.

As described above, the protruding portions 121, 122 are provided continuously along the axial direction in the melt pouring portion 120 and formed with a phase variance in one circumferential direction of the melt pouring spout 120 from the upstream side towards the downstream side in the flow direction of the melt M during pouring.

Figure 5:
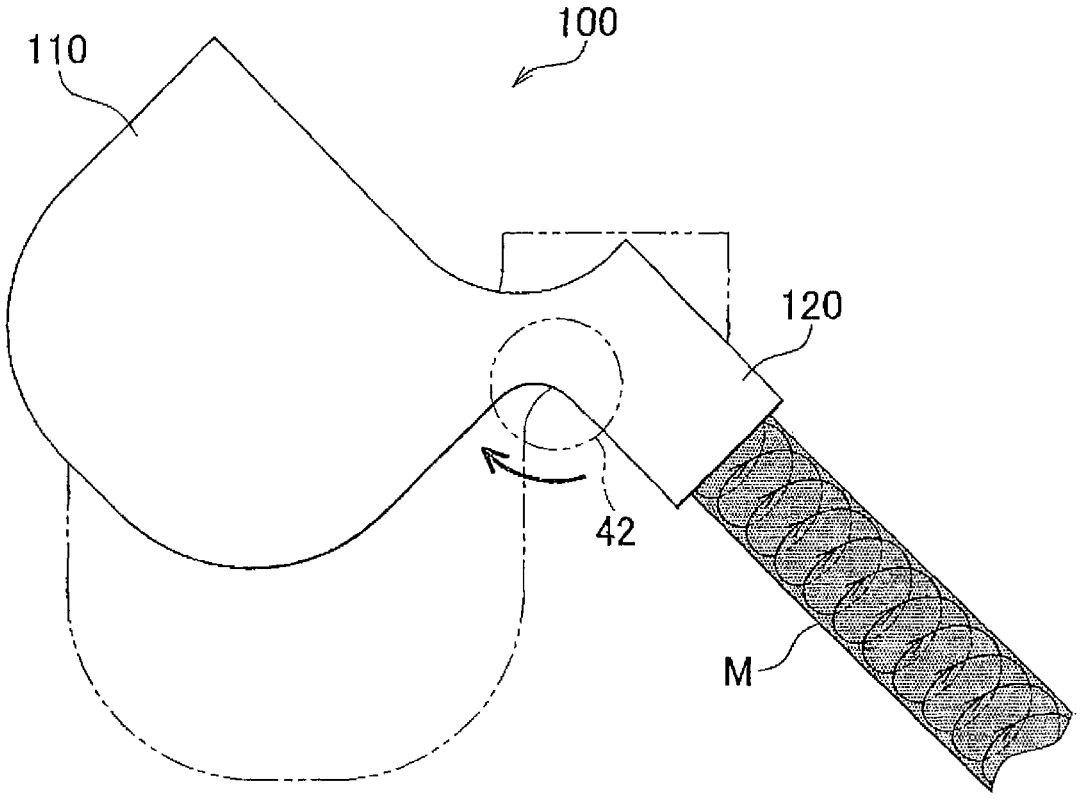
FIG. 5 illustrates the rotation of melt poured out from a melt pouring spout of the ladle according to one embodiment of the invention.

Therefore, as shown in FIG. 5, a swirling flow is generated in the melt M as it is poured out through the melt pouring spout 120 of the ladle 100 during pouring (the melt M is rotated in one circumferential direction along the melt pouring spout 120), thereby rotating the melt M spirally along the pouring direction. More specifically, when the melt M passes through a melt pouring spout 120 provided with the protrusions 121, 122, the melt M rotates in the phase variation direction (direction shown by the arrow in FIG. 4) of the protruding portions 121, 122, which is the circumferential direction of the melt pouring spout 120.

As a result, the melt M poured out of the melt pouring spout 120 of the ladle 100 is imparted with straight advance ability and the replacement efficiency of the melt M and air in the vicinity of the axial center of the melt pouring spout 120, that is, in the vicinity of the rotation center of the melt M is improved. Therefore, even if the speed at which the ladle 100 is tilted towards the melt pouring spout 120 side (rotated about the rotary shaft 42 as a center) increases, the pouring can be performed within a short time period, without the melt M overflowing the ladle 100 and without the melt M spilling around from the melt supply gate 21. As a result, the temperature of the melt M inside the sleeve 20 (pressurization chamber 50) is prevented from decreasing and the melt M is prevented from partial solidification. Therefore, pores (cavities) generated in the melt M inside pressurization chamber 50 may be completely eliminated thereby improving the quality of the cast article without reducing the propagation of pressure when the melt M located in the pressurization chamber 50 is injected into the cavity 13 by the plunger 30.

The range of phase variation of the protruding portions 121, 122 in the melt pouring spout 120 is not particularly limited. Any range may be selected, provided that the melt M may be suitably rotated in one circumferential direction in the melt pouring spout 120 and the melt M can be imparted with straight advance ability.

Further, the protrusions 121, 122 are formed to decrease gradually in size and curve gradually in one circumferential direction in the melt pouring spout 120 (rotation direction of the melt M which is the respective phase variation direction of the protruding portions 121, 122) towards the inside in the radial direction of the melt pouring portion 120.

As a result, the melt M rotates smoothly along the direction of curvature of the protrusions 121, 122, without coming into contact with the distal ends of the protrusions 121, 122 near the axial center of the melt pouring spout 120 (see internal arrows in FIG. 4). Therefore, the melt M is better rotated in one circumferential direction in the melt pouring spout 120 than when the protrusions 121, 122 are not curved, and the melt M poured out of the melt pouring portion 120 is be imparted with straight advance ability.

Further, the protrusions 121, 122 are formed so that the cross-sectional area of the protrusions 121, 122 in the axial section of the melt pouring spout 120 gradually increases from the upstream side towards the downstream side in the flow direction of the melt M when poured. More specifically, the protrusions 121, 122 are formed such that the height and width thereof increase gradually from the upstream side towards the downstream side in the flow direction of the melt M during pouring.

As a result, when the melt M flows through the melt pouring spout 120, the flow of the melt M can be prevented from being divided by the protrusions 121, 122. Therefore, the melt M is better rotated in one circumferential direction in the melt pouring portion 120 than when cross-sectional area of the protrusions 121, 122 in the axial section of the melt pouring spout 120 does not gradually increase from the upstream side towards the downstream side in the flow direction of the melt M, and the melt M poured out of the melt pouring portion 120 can be imparted with straight advance ability.

Further, in the present embodiment, the two protrusions 121, 122 are disposed on the lower side in the vertical direction and upper side in the vertical direction along the inner circumferential surface of the melt pouring spout 120, but the number and positions of the protruding portions are not limited and can be optimally set according to the requirement of the pouring method. In the present embodiment, melt pouring is performed by tilting the ladle 100 toward the melt pouring spout 120 side (rotating the ladle about the rotary shaft 42 as a center). For this reason, the protrusions 121, 122 are disposed on the lower side in the vertical direction and upper side along the vertical direction at the inner circumferential surface of the melt pouring portion 120 where the time of contact with the melt M is comparatively long. Therefore, the melt M is better rotated in one circumferential direction in the melt pouring portion 120 than when the protrusions are disposed in the zones of the melt pouring spout 120 where the time of contact with the melt M is comparatively short, and the melt M poured out of the melt pouring portion 120 can be imparted with straight advance ability.

Further, in the present embodiment, the protrusions 121, 122 are provided along the inner circumferential surface of the melt pouring spout 120 to rotate the melt M in the circumferential direction of the melt pouring spout 120 when the melt M is poured, but any suitable means that rotates the melt M in the circumferential direction of the melt pouring spout 120 may be used. For example, a configuration may be adopted in which a rotating screw rotating concentrically with the melt pouring portion 120 is provided within the melt pouring spout 120 and rotated so that the melt M is rotated in the circumferential direction of the melt pouring spout 120.

A casting process S1 using the casting apparatus 1 according an embodiment of the die-cast casting method of the invention will be described below with reference to FIGS. 6 to 12. In FIGS. 7 to 12, the melt pouring machine 40 is not shown and only the ladle 100 is shown for the sake of convenience.

Figure 6:
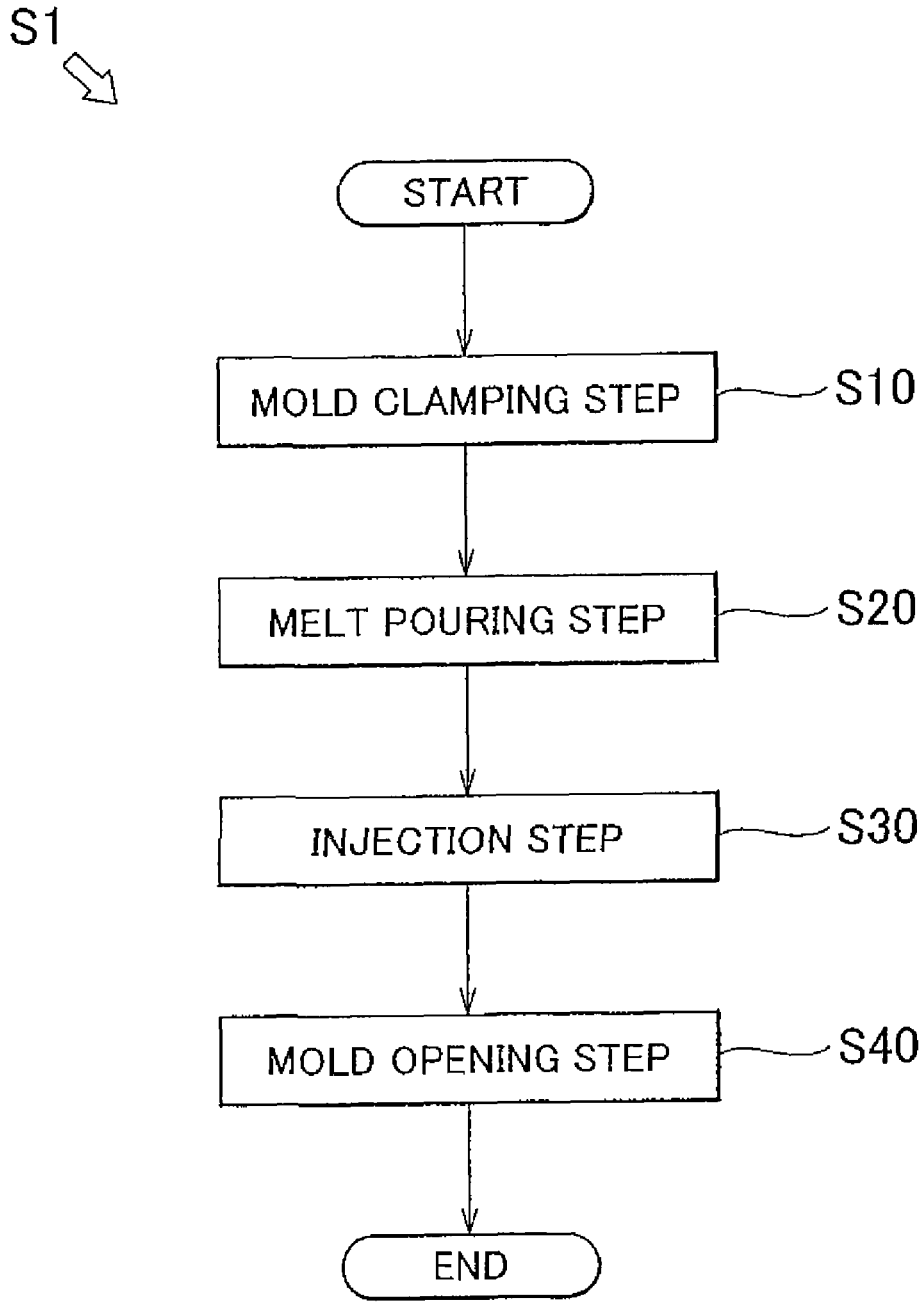
FIG. 6 is a flowchart illustrating a die-cast casting method according to one embodiment of the invention.

As shown in FIG. 6, the casting process S1 includes a mold clamping step S10, a melt pouring step S20, an injection step S30, and a mold opening step S40.

Figure 7:
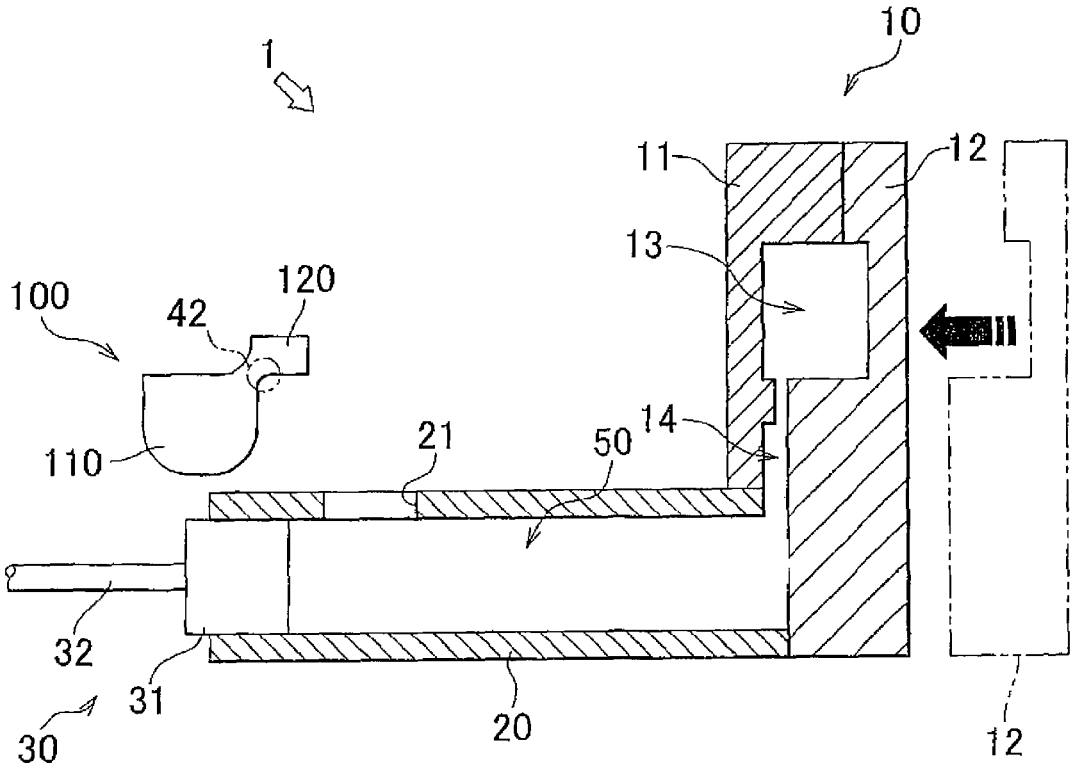
FIG. 7 illustrates a mold clamping step according to one embodiment of the invention.

In the mold clamping step S10, the cavity 13 and the runner 14 are formed inside the die 10 when the movable mold 12 is pressed against the fixed mold 11 (mold clamping). As shown in FIG. 7, in the mold clamping step S10, the movable mold 12 is moved towards the fixed mold 11 by the control means so that the fixed mold 11 and the movable mold 12 are pressed against each other so as to mate at the mold separation surfaces thereof, to thereby form the cavity 13 and the runner 14 inside the die 10.

Figure 8:
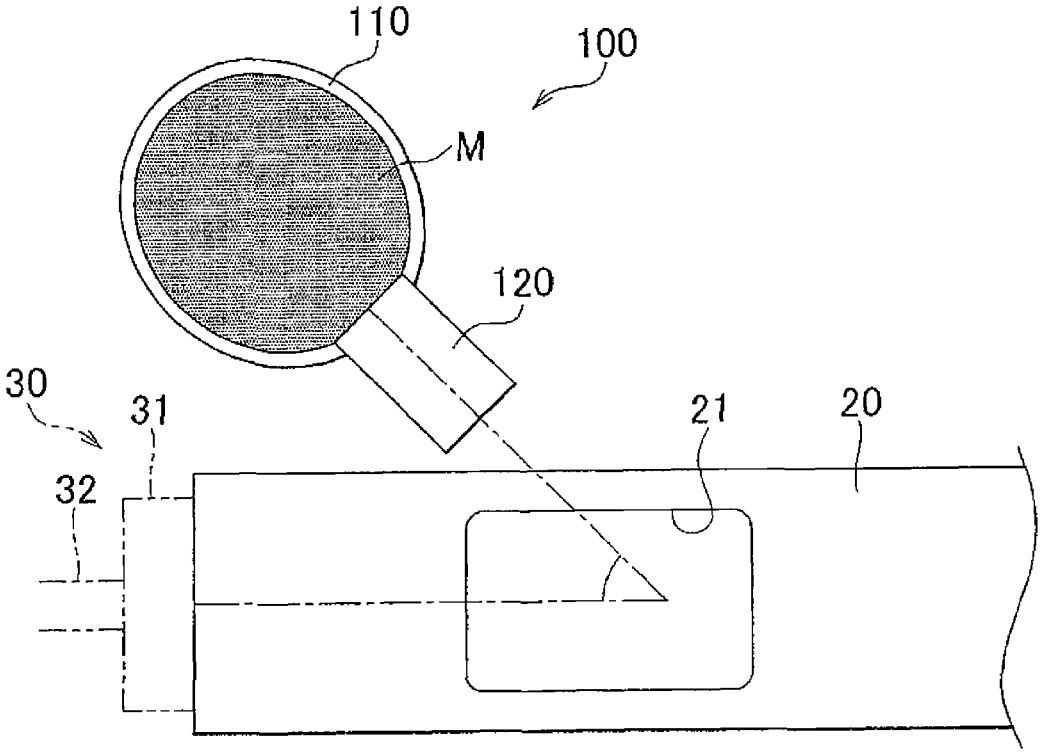
FIG. 8 illustrates the position of the ladle with respect to the sleeve in the pouring step according to one embodiment of the invention.

In the melt pouring step S20, the ladle 100 pours the melt M into the pressurization chamber 50 formed inside the sleeve 20. Specifically, the ladle 100 is first moved to the holding furnace, the predetermined amount (amount necessary to cast the cast article C) of the melt M held in the holding furnace is scooped up by the ladle 100, and the melt M is held in the accommodation portion 110. Then, as shown in FIG. 8, the ladle 100 is moved toward the position above the melt supply gate 21 so that the angle formed by the axial center of the melt pouring spout 120 and the axial center of the sleeve 20 is about 45 degrees. This is because the melt cannot be poured if the angle formed by the axial center of the melt pouring portion 120 of the ladle 100 and the axial center of the sleeve 20 is about 0 degrees due to the configuration of the casting apparatus 1 (mutual arrangement of the sleeve 20 and the melt pouring machine 40, and the like). In the present embodiment, the ladle 100 is disposed on the left side, as viewed from the plunger 30 side (upper side in FIG. 8), with respect to the sleeve 20.

Figure 9:
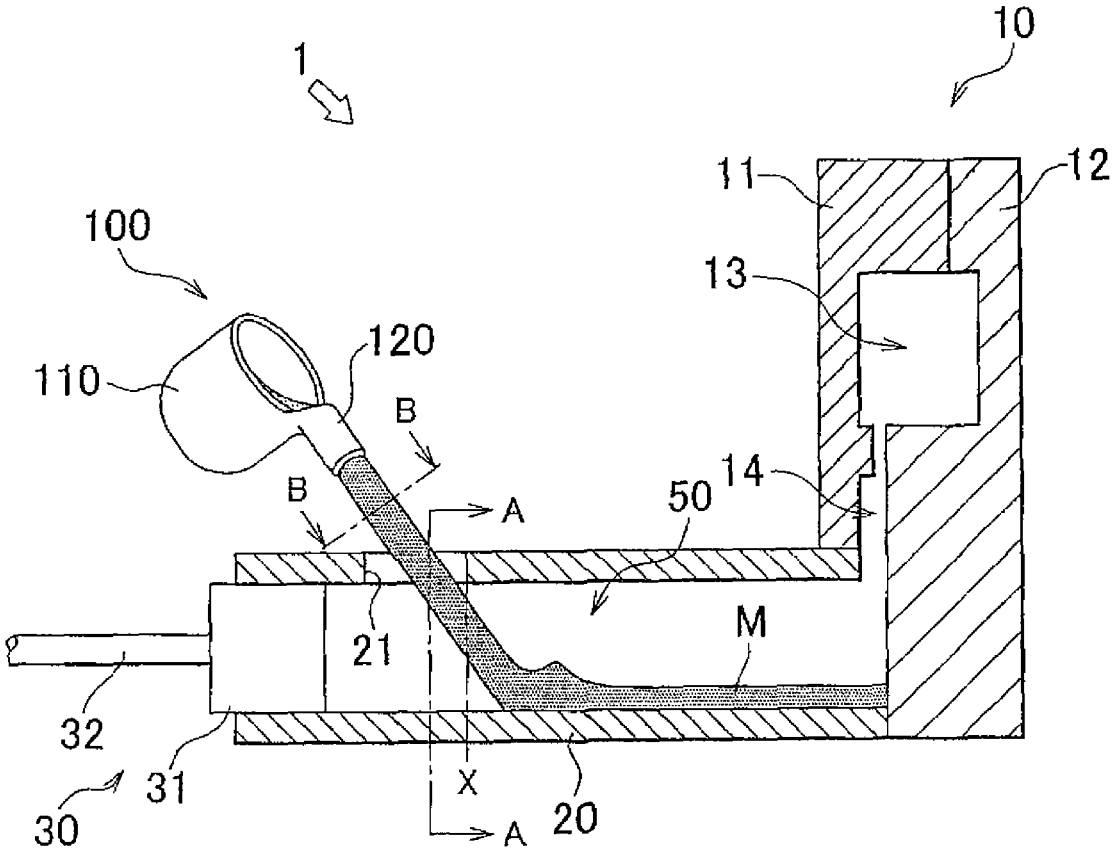
FIG. 9 illustrates how the melt is supplied into the sleeve in the pouring step according to one embodiment of the invention.

Then, as shown in FIG. 9, the ladle 100 is tilted at the melt pouring spout 120 side at a predetermined angle (rotated about the rotary shaft 42 as a center), thereby pouring out the melt M from the melt pouring spout 120 towards the melt supply gate 21 of the sleeve 20 and supplying the melt M into the pressurization chamber 50 formed in the sleeve 20. In this case, the melt M poured through the melt pouring spout 120 is caused to fall forward (on the right side from the melt supply gate 21 in FIG. 9) of the portion (position shown by a dot-dash line X in FIG. 9) where one end of the melt supply gate 21 is positioned (right end of the melt supply gate 21 in FIG. 9) in the pressurization chamber 50. In other words, the melt M poured through the melt pouring spout 120 is caused to fall on the downstream side (right side in FIG. 9) in the injection direction of the melt M with the plunger 30 from the portion where the melt supply gate 21 is positioned in the axial direction inside the sleeve 20. As described above, because the protrusions 121, 122 are provided in the melt pouring spout 120 of the ladle 100 that is used in the melt pouring step S20, the melt M is poured out of the melt pouring spout 120 in a state in which the melt has straight advance ability and the poured-out melt M does not spread in a wide range. Therefore, as described above, the melt M can be caused to fall with pinpoint accuracy into a certain desirable position inside the sleeve 20 (pressurization chamber 50). As a result, the melt M that has fallen into the sleeve 20 (pressurization chamber 50) is prevented from bouncing back at the inner circumferential surface of the sleeve 20 and overflowing from the melt supply gate 21 of the sleeve 20. As a result, cost of the casting process S1 in which the cast article C is cast can be reduced. Further, because the melt M may be supplied into the pressurization chamber 50 within a short time period, the time required for the casting process S1 in which the cast article C is cast (casting cycle time) may be reduced.

Figure 10A:
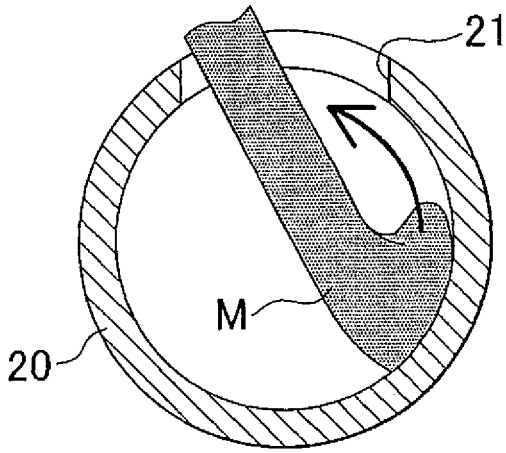
FIG. 10A is a sectional view taken along the A-A line in FIG. 9 that shows the rotation of melt in one embodiment of the invention.
Figure 10B:
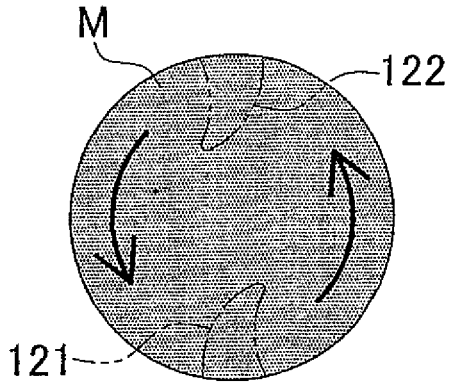
FIG. 10B is a sectional view taken along the B-B line in FIG. 9 that shows the rotation of melt in one embodiment of the invention.

Furthered, as described above, in the present embodiment, the ladle 100 is disposed on the left side (upper side in FIG. 8), as viewed from the plunger 30, of the sleeve 20. Therefore, as shown in FIG. 10A, the melt M that has fallen into the sleeve 20 (pressurization chamber 50) rotates counterclockwise, as viewed from the other end side (left end side of the sleeve 20 in FIG. 9, which is the upstream side in the injection direction of the melt M by the plunger 30) of the sleeve 20 inside the sleeve 20 (pressurization chamber 50). In this case, as described above, when the melt M passes through the melt pouring spout 120, the melt is rotated in the phase variation direction of each of the protrusions 121, 122 which is the circumferential direction of the melt pouring portion 120. Therefore, as shown in FIG. 10B, the melt M poured out of the melt pouring spout 120 rotates counterclockwise, as viewed from the upstream side in the flow direction of the melt M.

Further, the rotation of the melt M that poured into the sleeve 20 (pressurization chamber 50) along the inner circumferential surface of the sleeve 20 is enhanced by the rotation (swirling flow) generated when the melt passes through the melt pouring spout 120. In other words, by causing the rotation direction of the melt M generated when the melt passes through the melt pouring spout 120 to match the direction in which the melt M rotates along the inner circumferential surface of the sleeve 20 when the melt is poured inside the sleeve 20 (pressurization chamber 50), the melt M supplied into the sleeve 20 (pressurization chamber 50) is flows forward (to the right in FIG. 9), while smoothly rotating along the inner circumferential surface of the sleeve 20. As a result, the melt M supplied into the sleeve 20 (pressurization chamber 50) may flow efficiently without stagnation in any specific region and is prevented from overflowing from the melt supply gate 21 of the sleeve 20, and the cost of the casting process S1 of casting the cast article C may thereby be reduced.

Further, in the present embodiment, the ladle 100 is disposed on the left side (upper side in FIG. 8), as viewed from the plunger 30, with respect to the sleeve 20, and the protrusions 121, 122 are provided in the melt pouring spout 120 of the ladle 100 so that the melt M poured out from the melt pouring spout 120 rotates counterclockwise, as viewed from the upstream side in the flow direction of the melt M. However, the invention is not restricted to the configuration of the described embodiment. Because the rotation direction of the melt M inside pressurization chamber 50 is determined by the position of the ladle 100 with respect of the sleeve 20, the shape of the protrusions of the melt pouring spout 120 may be set to match the rotation direction with the direction in which the melt M rotates when it passes through the melt pouring portion 120 and thereby enhance the rotation along the inner circumferential surface of the sleeve 20.

Figure 11:
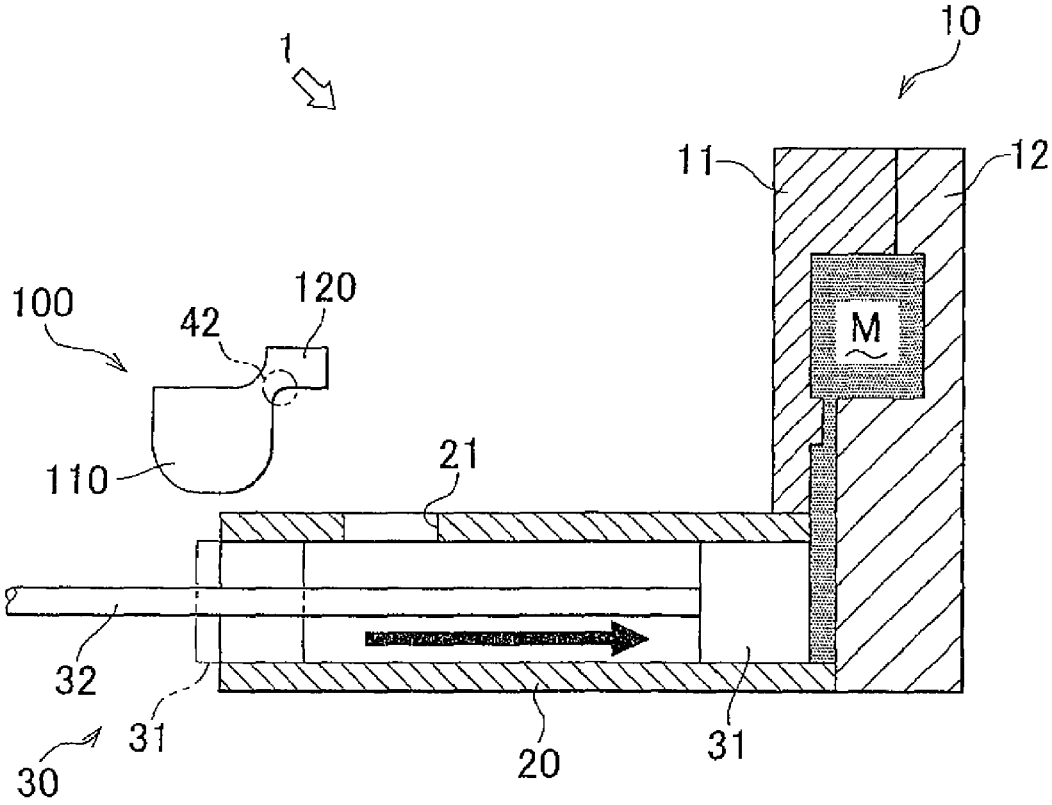
FIG. 11 illustrates the injection step according to one embodiment of the invention.

In the injection step S30, the melt M supplied into the pressurization chamber 50 is injected by the plunger 30 into the cavity 13 of the die 10. As shown in FIG. 11, in the injection step S30, the tip 31 is moved toward the die 10 inside the sleeve 20 by the actuator via the rod 32 and the volume of the pressurization chamber 50 is reduced. As a result, the melt M that has been supplied to the pressurization chamber 50 is pushed out towards the distal end (cavity 13 side) of the sleeve 20. The melt M is thus injected into the cavity 13 via the runner 14 and the cavity is thereby filled. In this case, both the cavity 13 and the runner 14 are filled with the melt M. Accordingly, the melt M filling the cavity 13 solidifies to form the cast article C.

Figure 12:
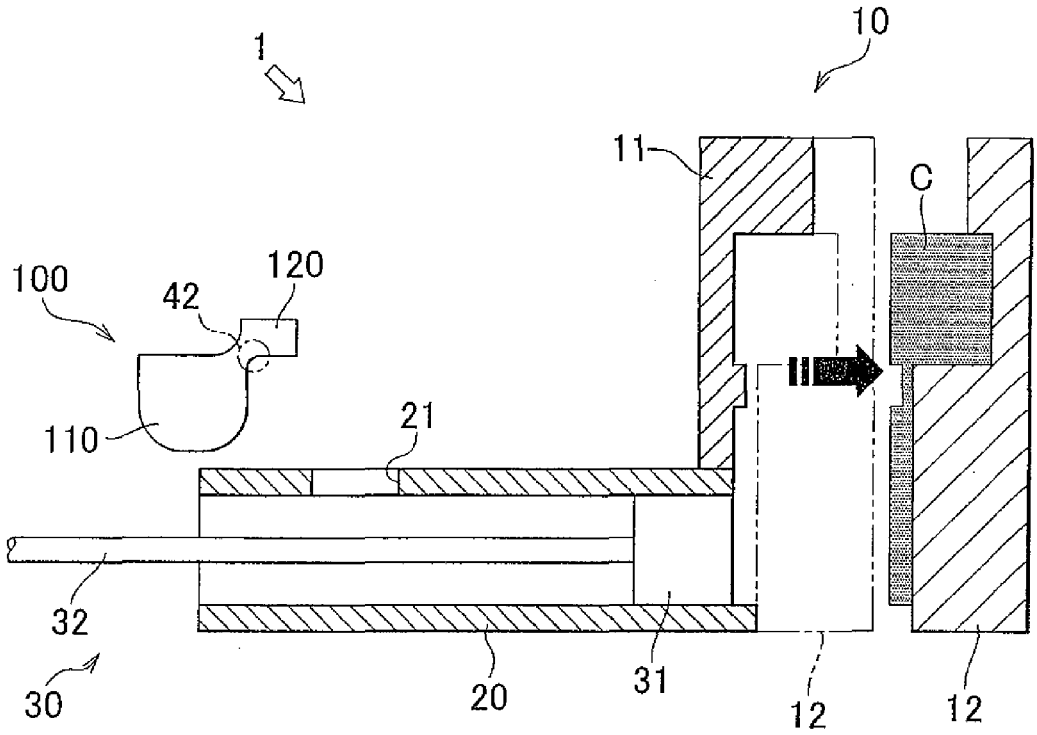
FIG. 12 illustrates a mold clamping step according to one embodiment of the invention.

In the mold opening step S40, the movable mold 12 is withdrawn from the fixed mold 11 (molds are opened) and the cast article C that has been formed inside the die 10 is taken out. As shown in FIG. 12, in the mold opening step S40, the movable mold 12 is withdrawn from the fixed mold 11 by the control means with the cast article C adhering to the movable mold 12. The cast article C is then taken out of the movable mold 12 with an appropriate removal means. As described above, in the injection step S30, both the cavity 13 and the runner 14 are filled with the melt M. The cast article C has an extra portion (the portion obtained by solidification of the melt M located in the runner 14 and the like). Therefore, the final product is obtained by removing this portion.

As described above, the cast article C is cast using the casting apparatus 1 and performing the casting process S1 in which the mold clamping step S10, melt pouring step S20, injection step S30, and mold opening step S40 are performed in sequence, and a final product is then manufactured from the cast article C. The invention is not restricted to this embodiment and may be also applied to a vacuum die-cast casting method or nonporous die-cast casting method, provided that a cold-chamber die casting machine is used.

The invention has been described with reference to example embodiments for illustrative purposes only. It should be understood that the description is not intended to be exhaustive or to limit form of the invention and that the invention may be adapted for use in other systems and applications. The scope of the invention embraces various modifications and equivalent arrangements that may be conceived by one skilled in the art.

The invention claimed is:

1. A die-cast casting apparatus comprising:

a die having a cavity formed inside thereof;

a tubular sleeve, having an internal space that is communicated with the cavity, in which a melt supply gate is formed, and in which the internal space is communicated with an outside of the tubular sleeve via the melt supply gate;

a ladle that includes an accommodation portion that holds a melt and a melt pouring spout that serves as a pouring gate, through which the melt accommodated in the accommodation portion is poured, wherein the ladle is tilted towards the melt pouring spout side such to pour the melt through the melt pouring spout towards the melt supply gate of the sleeve and thereby supply the melt into the sleeve, and a plunger provided slidably within the sleeve that is used to inject the supplied melt into the cavity, the apparatus wherein:

the melt pouring spout of the ladle is cylindrical and protrudes outward from the accommodation portion continuously with the accommodation portion, the melt pouring spout includes a rotation portion that rotates the melt in the circumferential direction in the melt pouring spout as the melt passes through the melt pouring spout when the melt is poured, the rotation portion is a screw that is provided inside the melt pouring spout and rotates concentrically with the melt pouring spout, and the screw rotates the melt in the circumferential direction of the melt pouring spout.

2. A die-cast casting method using the die-cast casting apparatus according to claim 1 in which the melt is supplied by pouring the melt into the sleeve from the ladle, the die casting method wherein:

the melt poured out of the melt pouring spout of the ladle is caused to fall downstream, in the injection direction of the melt with the plunger, of the position of the melt supply gate in the axial direction of the sleeve.

3. The die-cast casting method according to claim 2, wherein a position of the ladle with respect to the sleeve when the melt is poured out of the melt pouring spout of the ladle is set so that a rotational direction of the melt, as viewed from the upstream side in the flow direction of the melt, matches a rotational direction of the melt along the inner circumferential surface of the sleeve, as viewed from the upstream side in the injection direction of the melt with the plunger, when the melt is supplied into the sleeve.

* * * * *